US005966839A

United States Patent [19]

Pohja et al.

[11] Patent Number: 5,966,839

[45] Date of Patent: Oct. 19, 1999

[54] GRATE ASSEMBLY FOR A FLUIDIZED BED BOILER

[75] Inventors: Martti Pohja, Tampere; Kari Haverinen, Moisio; Jouni Kinni, Tampere, all of Finland

[73] Assignee: Kvaerner Pulping Oy, Tampere, Finland

[21] Appl. No.: 08/834,842

[22] Filed: Apr. 10, 1997

[30] Foreign Application Priority Data

Apr. 15, 1996 [FI] Finland ..... 961653

[51] Int. Cl.[6] ..... F26B 17/00

[52] U.S. Cl. ..... 34/578

[58] Field of Search ..... 34/578, 576; 110/234

[56] References Cited

U.S. PATENT DOCUMENTS

| | | | |
|---|---|---|---|
| 5,425,331 | 6/1995 | Abdulally | 122/4 D |
| 5,743,197 | 4/1998 | Kinni et al. | 110/245 |

FOREIGN PATENT DOCUMENTS

| | | |
|---|---|---|
| 0 019 652 | 12/1980 | European Pat. Off. . |
| 89202 | 5/1993 | Finland . |
| 98405 | 6/1995 | Finland . |
| 9404099 | 6/1995 | Sweden . |
| 1149105 | 4/1985 | U.S.S.R. . |
| 1177596 | 9/1985 | U.S.S.R. . |
| 2 075 360 | 4/1981 | United Kingdom . |

*Primary Examiner*—Henry Bennett
*Assistant Examiner*—Malik N. Drake
*Attorney, Agent, or Firm*—Pollock, Vande Sande & Amernick

[57] ABSTRACT

A grate assembly for a fluidized bed boiler is provided. A number of parallel sparge pipes extending substantially in the horizontal direction and are provided with devices for supplying fluidizing air from within sparge pipes into a combustion chamber located above the grate assembly. The discharge of coarse material is effected through an aperture system between the sparge pipes into a receiver unit fitted below the grate assembly. At least some of the sparge pipes are provided with a cool medium circulation, wherein at least a part of the cool medium circulation is placed in the sparge pipes at the upper edges thereof, to extend so that it provides a limit to the edge of the aperture system in the upper part of the sparge pipe in the longitudinal direction of the sparge pipe. Devices for supplying fluidizing air comprise a tubular supply channel that is directed from the upper surface of the sparge pipe. The supply channel is provided with air nozzle apertures at its upper part. The supply channel for at least some of the devices for supplying fluidizing air is fitted in vertical direction to extend on top of a part of the cool medium circulation in a vertical direction.

11 Claims, 6 Drawing Sheets

GRATE ASSEMBLY FOR A FLUIDIZED BED BOILER

FIELD OF THE INVENTION

The present invention relates to a grate assembly for a fluidized bed boiler to be used in particular in connection with a layered fluidized bed or a circulation fluidized bed. The grate assembly consists at least partially of a number of parallel sparge pipes or the like extending side-by-side in a substantially horizontal plane. The sparge pipes are provided with means for supplying fluidizing air from within the sparge pipes or the like into a combustion chamber located above the grate assembly. The discharge of coarse material is effected through an aperture system situated between the sparge pipes or the like into a receiver unit fitted below the grate assembly. At least some of the sparge pipes are provided with a cool medium circulation, wherein at least a part of the cool medium circulation is arranged in the sparge pipes at the upper edges thereof to extend in such a manner that it provides a limit to the edge of the aperture system in the upper part of the sparge pipe in the longitudinal direction of the sparge pipe. The means for supplying fluidizing air comprise a tubular supply channel which is directed upwards from the upper surface of the sparge pipe or the like. The supply channel is provided with air nozzle apertures at the upper part thereof.

BACKGROUND OF THE INVENTION

A grate assembly for a fluidized bed boiler of the above-described type is described in Finnish patent application FI-935455. The grate assembly described in this patent application has proved to be very functional in practice, in particular with regard to cooling the grate assembly. It has been noticed in practice that for cooling of the sparge pipe it is advantageous to position the cool medium circulation at least partially at the upper edges of the sparge pipes in such a manner that the cool medium channel of the cool medium circulation, in particular the cooling duct, is arranged in two adjacent sparge pipes to be situated at the upper edges of the aperture system. An implementation of this type of cool medium circulation is shown in FIG. 3 of Finnish patent application FI-935455. Thus, the edge area which is critical in view of the endurance of the sparge pipe, is cooled, wherein no high heat tensions are effected thereto. This applies in particular to the corner area where the substantially horizontal upper surface of the cross section of the sparge pipe is changed to a substantially vertical side wall of the sparge pipe, i.e., to the substantially vertical side edge of the aperture system. On the other hand, this structure, advantageous with regard to cooling of the sparge pipe, involves problems in particular prior art solutions, the means for supplying fluidizing air have to be placed, in particular as to the air supply location, i.e. the junction between the upper surface of the sparge pipe and the means for supplying fluidizing air, further away from the aperture system, to the upper surface of the sparge pipe, perpendicularly to the longitudinal direction of the aperture system. This is effected specifically by the fact that the cool medium circulation is placed, at least partially, at the upper corners of the sparge pipes. However, it should be noted that in view of the operation of the fluidizing process, the fluidizing air has to be distributed evenly to the fluidized bed situated above the grate assembly. In other words, the entire fluidized bed has to be kept in a fluidized phase. So-called coarse material is accumulated specifically at such places in the fluidized bed where the air blow is insufficient. In case a process condition of this kind is effected at the aperture system in the grate assembly that is composed, at least partially, of sparge pipes, the danger exists that the aperture system chokes owing to the fact that there is no air blow or an insufficient air blow at the aperture system. Consequently, larger sintered pieces formed of coarse material are produced at the aperture system, and it is most probable that these pieces will eventually block the aperture system, at least partially. It is obvious that the air supply could be effectuated to be smooth and sufficient for maintaining a fluidized phase in the fluidized bed by increasing the air blow through nozzles or by enlarging the nozzle apertures, but in that case it is most probable that excessive air blows have to be introduced, which may cause disturbances to the process itself. In any case, excessive air blows increase the energy consumption of the process.

The above described drawbacks have given rise to the present invention which further improves and raises the level of technology related to cooled grate assemblies composed of sparge pipes and used in fluidized bed boilers. A particular purpose of the present invention is to ensure a smooth supply of fluidizing air for maintaining the fluidized bed, in particular in such the area of the aperture system in a manner that the energy costs are reasonable and the aperture system is not choked.

DETAILED DESCRIPTION OF THE PREFERRED EMBODIMENT(S)

Figure 1:
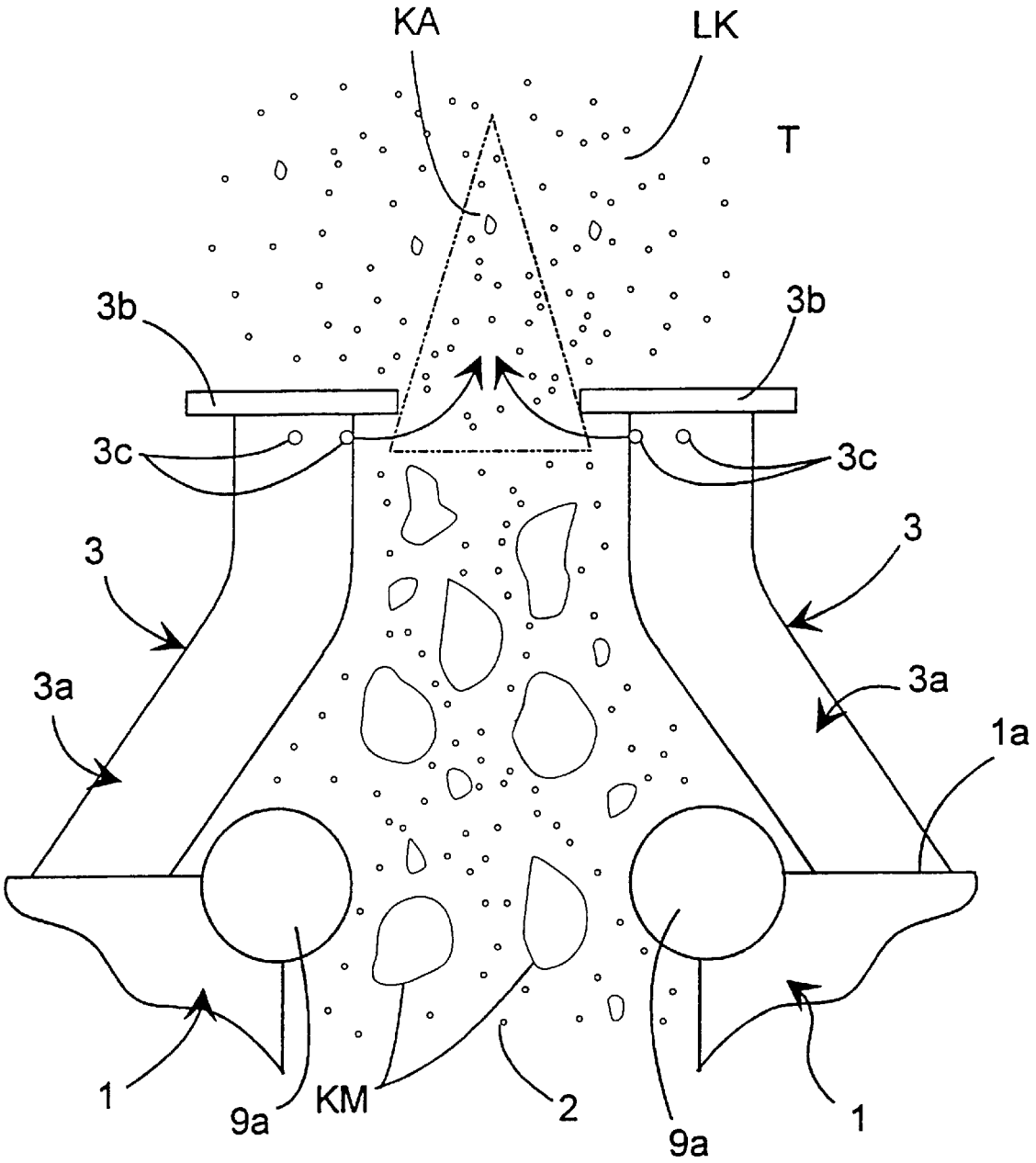
FIG. 1 shows schematically the theoretical basis of the invention in a vertical cross section that is perpendicular to the longitudinal direction of the sparge pipes.

With reference made to FIG. 1, the solution according to the invention is particularly important in view of the fact that the aperture system 2 between the two sparge pipes 1 of the grate assembly is kept open by using reasonable amounts of air. In combination with upper edges directed to the aperture system 2 of the sparge pipes 1, at the edge of the aperture system 2, cool medium ducts 9*a* belonging to a cool medium circulation 9 of the grate assembly are placed, the ducts 9*a* extending parallelly in the longitudinal direction of the aperture system, with cool medium, such as water, running inside the cool medium ducts 9*a*. From within the sparge pipes 1 (not shown in FIG. 1), cooling air is directed through means 3 to the combustion chamber T in the fluidized bed LK. The means 3 are formed of a tubular supply channel 3*a* and a substantially horizontal protective sheet 3*b* at the upper part, the protective sheet 3*b* being e.g. a rectangular or square-formed flat sheet having a diameter larger than the cross-section area of the tubular supply channel 3*a,* at the upper end of the supply channel 3*a*. Below the protective sheets 3*b,* on the wall of the supply channel 3*a,* air nozzle apertures 3*c* are formed, through which at the location of the grate assembly the supply of fluidizing air is effected over to the aperture system 2.

FIG. 1 shows an optimal situation, wherein the removal of fluidized bed material from the fluidized bed of the combustion chamber T is effected via the aperture system 2, in such a manner that the coarsening material KM cannot grow in a manner that its particle size becomes larger than the transverse cross section of the aperture system, at least with regard to all of its dimensions, to that the coarsening material can leave the combustion chamber T. FIG. 1 shows a line of dots and dashes indicating a so-called critical area KA adjacent above the aperture system 2, in which critical area KA it is particularly important to ensure a sufficient velocity for cooling air, so that it is particularly necessary to prevent sintering and thus formation of coarse material. In a manner characteristic to the invention this is implemented without utilizing amounts of air blows that would increase the energy consumption excessively; in other words, the locations where the nozzle apertures 3*c* are placed are optimized in consideration with the continuation of the fluidizing process and energy consumption. It is obvious that a specific penetration length can be found for specific air blows and nozzle aperture sizes as well as for the supply pressures used. The penetration length is the length which the air supplied via the fluidizing air aperture can proceed in the fluidized bed before the movement energy is consumed.

As shown in FIG. 1, part 9*a* of the cool medium circulation that is situated at the edges of the aperture system 2 of the sparge pipes prevents the directly upwards extending supply channel 3*a* from being positioned in such a manner that the fluidizing air is brought from the upper surface 1*a* of the sparge pipe 1, from the edge thereof directly to the aperture 2. The tubular parts 9*a* are advantageously connected in particular by welding to the edges of the substantially rectangular cross section of the sparge pipe 1 in a manner that about ¾ (three fourths) of the outer periphery of the part 9*a* is the part defining the outer surface of the sparge pipe 1, i.e. the sheets of the upper surface (1*a*) and the side wall are connected to the part 9*a* in a perpendicular position to each other. Thus, the part 9*a* is positioned at least partially at the area of the upper surface la of the sparge pipe. Thus, in accordance with the invention, the means 3 have to be designed so that the connective location between the upper surface 1*a* of the sparge pipe and the tubular supply channel 3*a* is relatively far from the aperture system 2, at the edge thereof, which is thus limited by the part 9*a* of the cool medium circulation 9. Thus, by design of the tubular supply channel 3*a* it is achieved that the air nozzle apertures 3*c* can be closer to the aperture system 2, at least partially on top of the part of the cool medium circulation, i.e. the cool medium pipes 9*a* in vertical direction. Through air nozzle apertures 3*c*, the fluidizing air that is supplied to the aperture system 2 can be supplied in view of the process and energy economy by using optimal blow rates and by using optimal nozzle aperture size, and to the fluidizing process with air blows that are optimal in view of the air needed. In other words, for the maintenance of fluidized bed, no air in excess to what is needed for the process to operate will be required, and therefore no additional energy will be required since the distance between the location of the air nozzle apertures 3*c* and the critical area KA of the fluidized bed is long.

Figure 2:
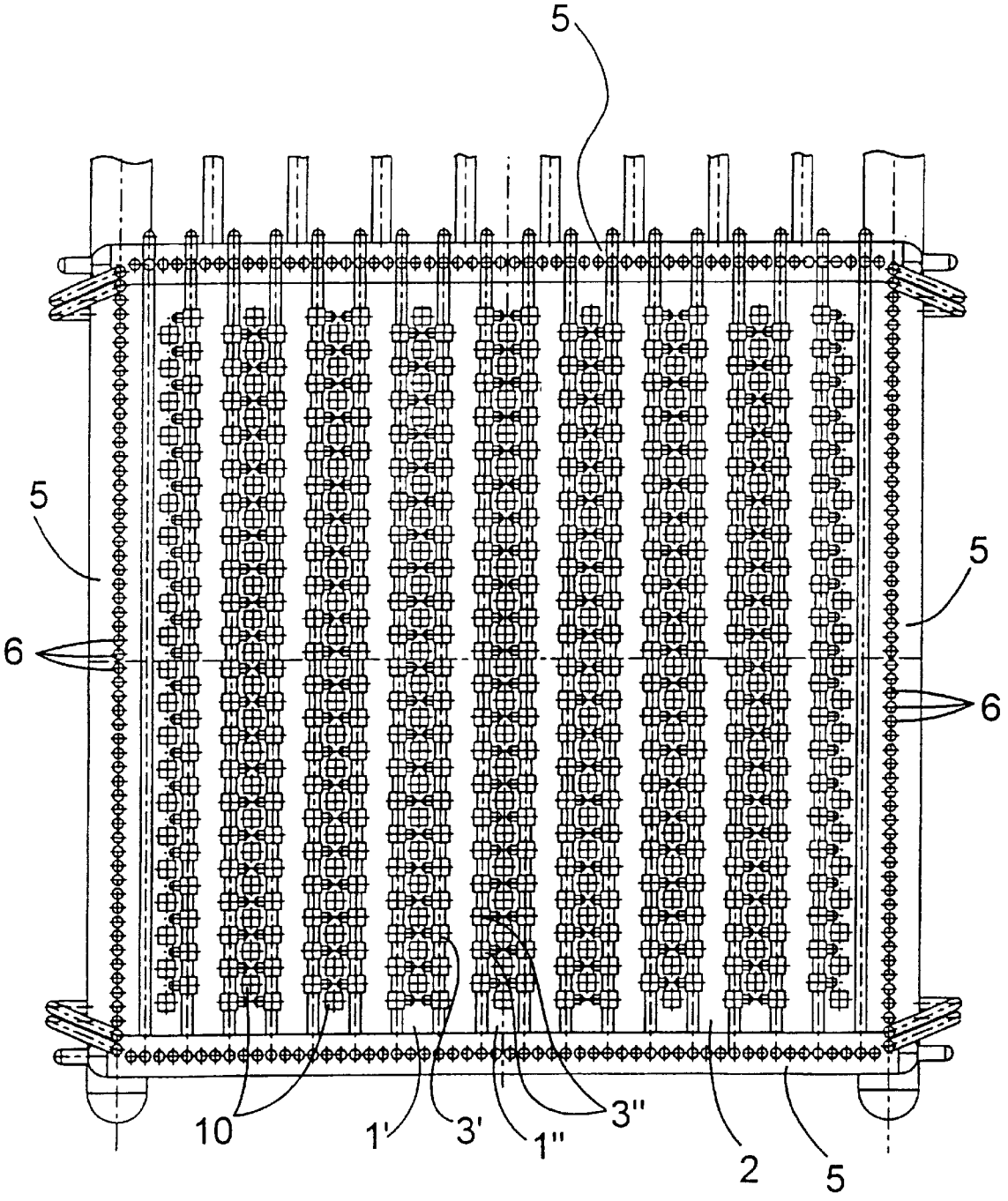
FIG. 2 shows a top plan view of one embodiment of the grate assembly in accordance with the invention.

FIG. 2 illustrates a grate assembly with a rectangular combustion chamber T. The described embodiment employs, the lower part of which water circulation comprising horizontal collector pipes 5 having a length of each part of the wall structure. The collector pipes 5 are connected to parallel, vertical rising ducts that form the wall structure. The grate assembly is combined to cool circulation. Since the basic structure of the water-cooled boiler assembly basic structure, known in the field and is not directly related to the scope of the invention, it is not described in more detail in this context. Substantial in FIG. 2, with regard to the present invention, is that the means 3 for supplying the fluidizing air connected to the edge of the aperture system 2 are in two adjacent sparge pipes placed to alternate in a manner that a means 3' for supplying fluidizing air in a first sparge pipe 1' is situated between two adjacent means 3" placed in a second sparge pipe 1", at the opposite edge of the aperture system 2, in the longitudinal direction of the sparge pipes 1' and 1". Thus, an optimal air supply is obtained in a manner that in the area of the aperture system 2, powerful air jets can be arranged, which air jets do not substantially disturb each other but maintain a sufficient air blow in the critical area KA (FIG. 1). The air nozzle apertures 3*c* can in this solution be placed even partially on top of the aperture system 2, because when the edge of the opposite aperture system 2 is, at the location, free from corresponding type of means 3 for supplying fluidizing air, a sufficient cross-section area is obtained the aperture system 2, viewed from the direction of FIG. 2, i.e. horizontal cross section of the boiler plant. Viewed from the top, the aperture system 2 is thus formed to be a sort of continuous broken-line form which has, above the aperture system 2, a horizontal zone at the means 3 for supplying fluidizing air, the horizontal zone limiting two "imaginary" edge lines that twist at various phases in the longitudinal direction of the aperture.

Figure 3:
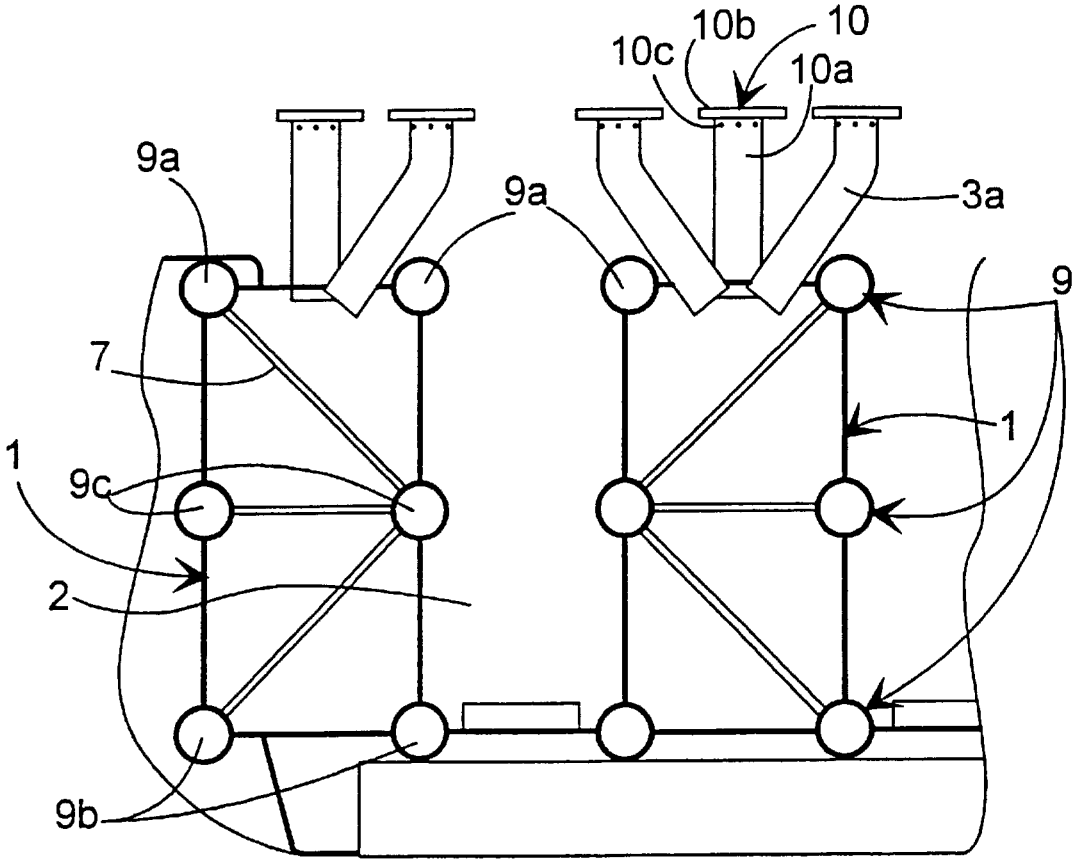
FIGS. 3 to 7 show some embodiments of the grate assembly in accordance with the invention and means for supplying fluidizing air, also in a vertical cross section that is perpendicular to the longitudinal direction of the sparge pipes.
Figure 4:
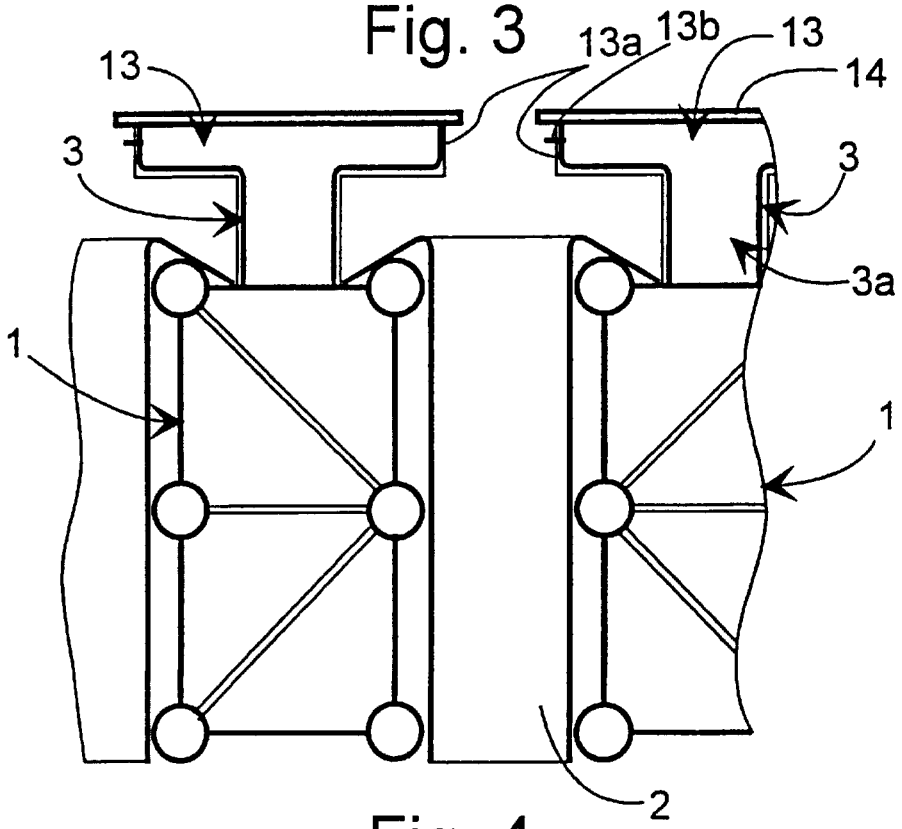

With particular reference to FIGS. 3 and 4, the cool medium circulation 9 of the sparge pipe comprises six cool medium ducts 9*a*, 9*b*, 9*c* placed in such a manner that the uppermost pipes 9*a* are placed at the upper corners of the rectangular form of the sparge pipe and correspondingly its lowermost pipes 9*b* are placed at the lower corners of the rectangular form, and the central 9*c* ones are placed in horizontal direction in connection with the side walls 1*c* of the sparge pipe. The sparge pipe 1 can comprise an internal support rib system 7, which can be partly diagonal. As shown also in FIG. 2, in the upper surface 1*a* of the sparge pipes 1 a second means 10 for supplying fluidizing air is placed in such a manner that means 10 is situated centrally on the upper surface 1*a* of the sparge pipe 1 in transverse direction. The means 10 are placed in longitudinal direction in a manner that after two means 3 for supplying fluidizing air that are transversely parallel with each other, the central means 10 for supplying fluidizing air always follows in the longitudinal direction of the sparge pipe 1, whereafter follows said pair of parallel means 3 for supplying fluidizing air. Means 10 that are situated centrally in relation to the upper surface 1*a* of the sparge pipe are so-called vertical means having a tubular supply channel 10*a* which is a duct directed directly upwards from the upper surface 1*a* of the sparge pipe. Furthermore, means 10 comprise a horizontal protective sheet 10*b*, as described earlier in connection with means 3. Air nozzle apertures 10*c* are placed below the protective sheet 10*b*.

Figure 5:
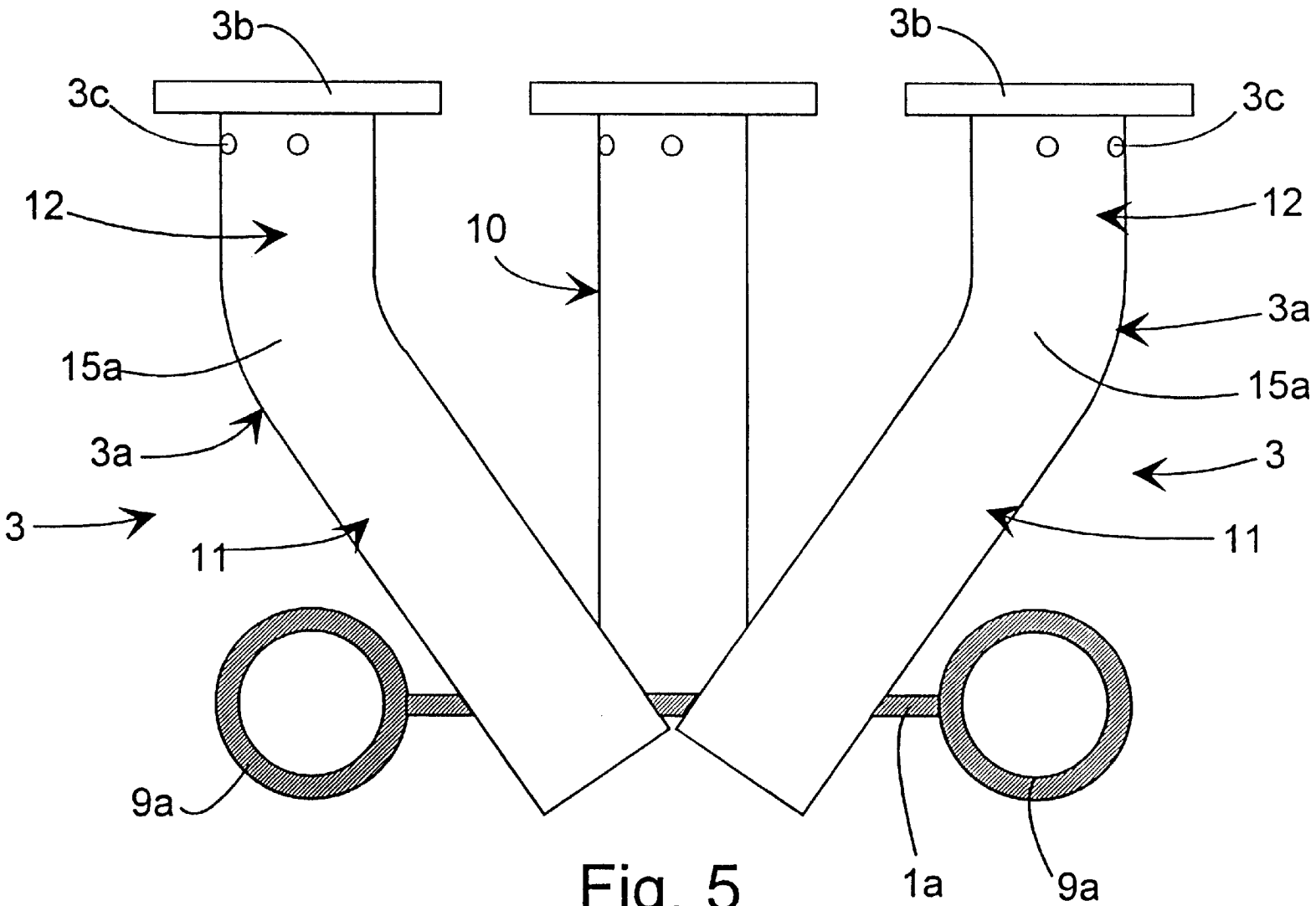
Figure 6:
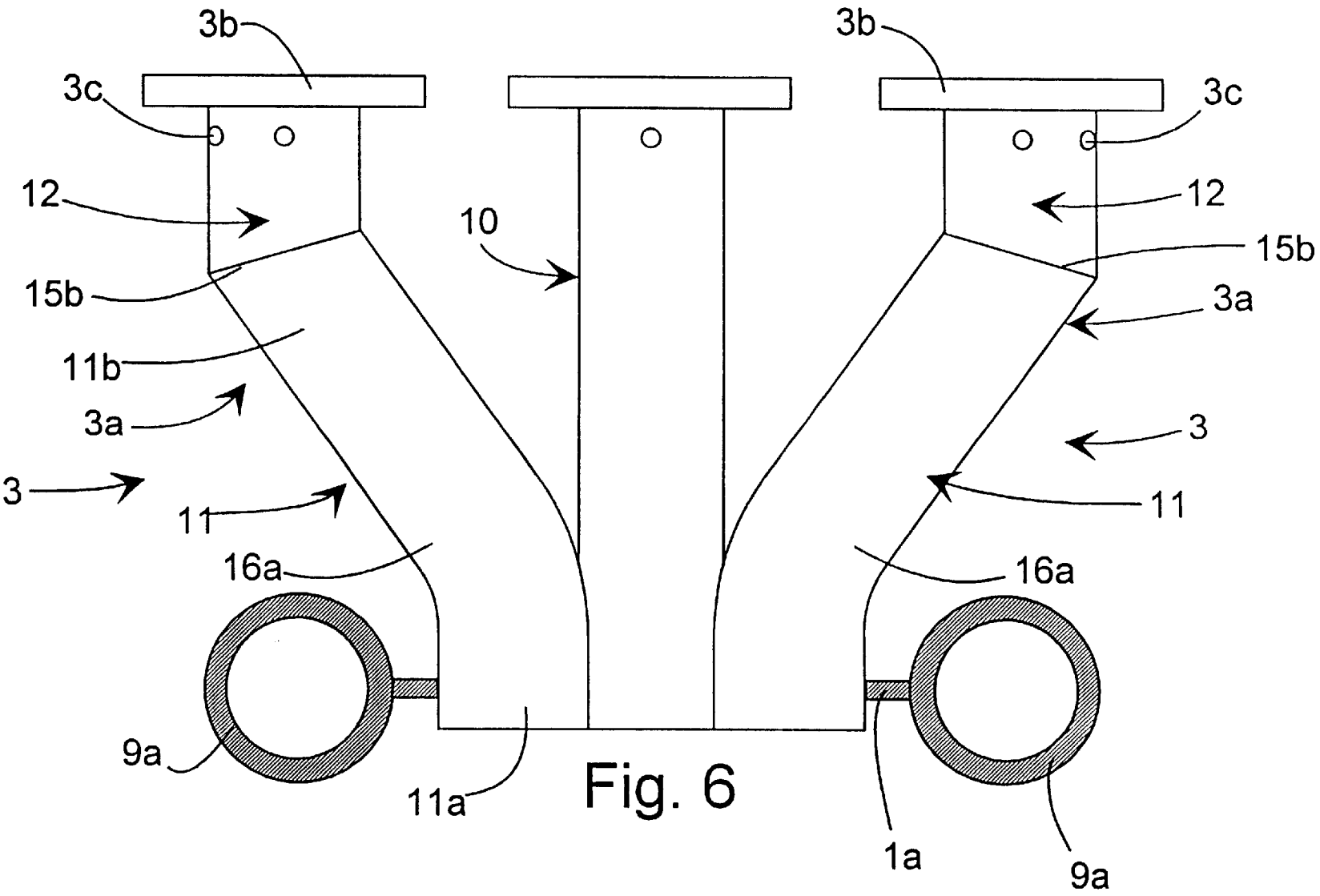
Figure 7:
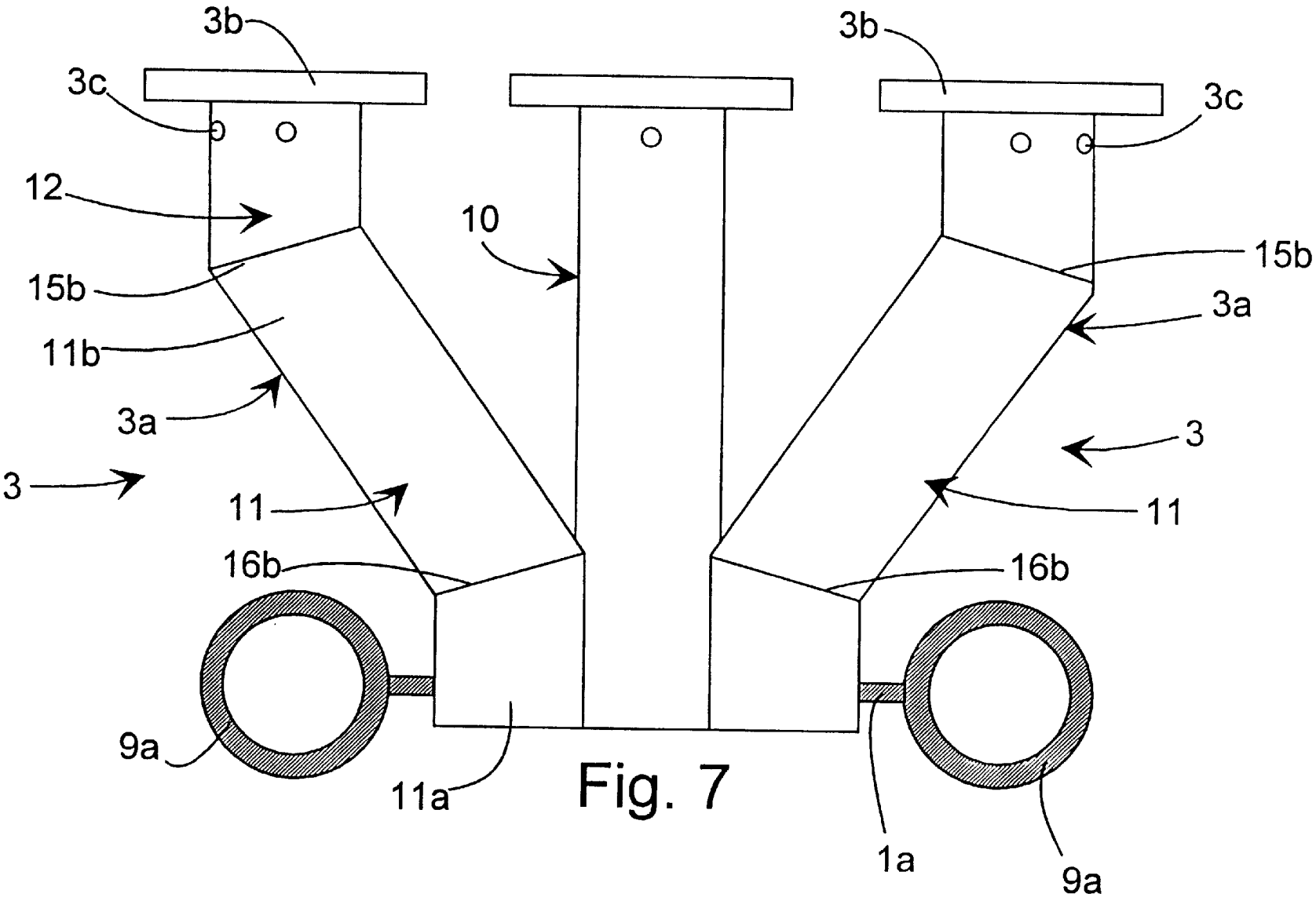

Substantial for means 3 for supplying fluidizing air in accordance with FIGS. 5 to 7 is that the tubular supply channel 3*a* has a tube shape comprising one or several changes of direction in the longitudinal axis thereof, with which changes of direction the location where the air nozzle apertures 3*c* are to be placed can be obtained in the mounted positions of the supply channel 3*a*, the tubular form of the supply channel 3*a* being effected either by bending the tube material (15*a*, 16*a*, cf. FIGS. 5 and 6) or by means of at least one welded joint (15*b*, 16*b*, cf. FIGS. 6 and 7) between the tube material. Thus, the lower part 11 of the tubular supply channel 3*a*, i.e. that part which is connected to the sparge pipe 1, at the upper surface 1*a* thereof, is directed obliquely upwards away from the vertical center line of the cross section of the sparge pipe, towards the aperture system 2. In a corresponding manner, the upper part 12 of the tubular supply channel 3*a* is formed in a manner that it is positioned substantially in a vertical position.

FIG. 4 shows a structural alternative for means 3 in which the tubular supply channel 3*a* is formed as a vertical tube which projects directly upwards from the upper surface 1*a* of the sparge pipe and comprises at its upper part a preferably horizontal extension part 13 which projects in transverse direction, and a protective sheet 14, whereby the extension part 13 is a radially horizontally expanding, preferably rectangular case form in connection of whose vertical wall 13*a* air nozzle apertures 13*b* are provided. The vertical wall 13*a* is placed in vertical direction at the location of the cool medium ducts 9*a* and possibly in the area of the aperture system 2, above the parts 9*a*, 2*a*, at a height which is substantially defined by the length of the supply channel 3*a*.

In particular with regard to the embodiments of FIGS. 6 and 7, the means 3 comprise double bending of the tubular supply channel, whereby the joint effected to the upper surface 1*a* of the sparge pipe 1 has a circular cross-section form. Thus, in the lower part 11 of the supply channel 3*a* a supplementary bending is formed, the bending dividing the lower part 11 into two parts 11*a*, 11*b*, the lower one 11*a* of which is vertical and the upper one 11*b* is directed obliquely upwards towards the aperture system 2. This is an important advantage when machining of a joint aperture for the supply channel 3*a* of the means 3 is effected in the upper surfaces of the sparge pipes 1. In the embodiments according to FIGS. 6 and 7, the machining can be implemented as a circular form, which can be machined more easily than the elliptic form required in connection with a joint of FIG. 5 wherein the upper part 11 of the supply channel 3*a* is direct.

EXAMPLE

One grate assembly of a fluidized bed boiler of the invention is implemented in the following manner:

The bottom of the combustion chamber T is manufactured of watercooled case-like primary air bellows. Each case-like primary pipe has a width of about 230 mm and a height of about 460 mm. Each pipe comprises six cooling pipes 9*a*, 9*b*, 9*c* (see FIG. 3) having an outer diameter of 60.3 mm in a manner that each corner of the rectangular cross section of the sparge pipe, as well as the central part of the vertical side walls, has a cooling duct and a sheet structure having a thickness of 6 mm therebetween. The pitch of the sparge pipes is about 460 mm. An aperture having a width of about 170 mm is situated between the sparge pipes, from which aperture the coarsening, sintering material that is discharged from the combustion chamber is removed through funnels and chutes (presented in application FI-935455). The means for supplying primary air, i.e. fluidizing air, into the combustion chamber are each welded on the upper surfaces of the rectangular shape of the sparge pipes in a manner that they are interlaced in the entire area of the combustion chamber.

For ensuring sufficient primary air, i.e. fluidizing air, altogether 680 means for supplying fluidizing air are placed in a regular manner over the entire area of the bottom of the combustion chamber. The distance between the means in the longitudinal direction of the sparge pipe is about 180 mm. For protecting the combustion chamber from wearing, the air nozzles that are situated below the means for supplying fluidizing air comprise an inactive layer of fluidizing medium, i.e. sand. Consequently, no protecting embedding is required on the bottom of the combustion chamber. Ash produced in connection with burning of the fuel is fine and is removed from the fluidized bed in form of flue dust, which is collected in the combustion gas cleaner provided in combination with a boiler plant. The combustion gas cleaner can be a cyclone or electric filter. The coarse material (bottom ash) that exists in the fluidized bed is removed from the combustion chamber e.g. via four removal funnels. The bottom funnels extend to the entire area of the bottom, as described e.g. in publication FI-935455.

We claim:

1. A grate assembly for a fluidized bed boiler, comprising:

a plurality of sparge pipes arranged parallel in a substantially horizontal plane and defining apertures therebetween;

a cooling medium circulation system, at least a first part of the system being placed in an upper edge of the sparge pipes so that the system provides a limit to an edge of the aperture in the longitudinal direction of the sparge pipes;

a tubular supply channel extending from an upper surface of the sparge pipe in a vertical direction over top of the first part of the cooling medium circulation system, the channel having air nozzle apertures provided at its upper part and providing fluidized air from the sparge pipes into a combustion area above the grate assembly.

2. A grate assembly as set forth in claim 1, wherein the supply channel has in its longitudinal direction at least one change of direction for placing the upper part of the supply channel, where the air nozzle apertures are situated, on top of the first part of the cool medium circulation.

3. A grate assembly as set forth in claim 1 wherein the supply channel comprises at least one change of direction which is placed between a first lower part of the supply channel, the first lower part being directed obliquely upwards, and a substantially vertical second part which is provided with the air nozzle apertures.

4. A grate assembly as set forth in claim 1 wherein the supply channel comprises two changes of direction, wherein a first change of direction placed between a first part directed obliquely upwards and a substantially vertical second part which is provided with the air nozzle apertures and a second change of direction is formed in connection with a lower part of the supply channel, wherein a first part of the lower part is vertical and is joined on the upper surface of the sparge pipe, and wherein a second part of the lower part is directed obliquely upwards.

5. A grate assembly as set forth in claim 4 wherein the second change of direction of the supply channel is formed so that the joint between the supply channel and the upper surface of the sparge pipe has a shape that corresponds to the outer surface form of the cross section of the supply channel, the outer surface form being perpendicular to the longitudinal direction of the supply channel.

6. A grate assembly as set forth in claim 2 wherein the change of direction of the tubular supply channel is formed of bent and welded tube forms.

7. A grate assembly as set forth in claim 2 wherein the change of direction is implemented by a case-like extension part in the upper part of the supply channel which expands in a transverse direction in the upper part of the supply channel over the upper surface of the sparge pipe.

8. A grate assembly as set forth in claim 1 wherein the supply channels are placed in pairs on the upper surface of the sparge pipe side-by-side in a perpendicular direction to the longitudinal direction of the sparge pipe to be directed towards the apertures situated on opposite edges of the sparge pipe, wherein a number of the pairs are placed one after another in a longitudinal direction of the sparge pipe.

9. A grate assembly as set forth in claim 1 wherein the supply channels are placed in pairs side-by-side, and further comprising in a longitudinal direction of the sparge pipe, a central means for supplying fluidizing air, the means being placed in the middle of the upper surface of the sparge pipe and directed directly upwards.

10. A grate assembly as set forth in claim 1 wherein the supply channels are arranged alternatingly in the longitudinal direction of the sparge pipes and wherein one supply channel placed in a first sparge pipe, is positioned between two adjacent supply channels situated in the longitudinal direction, in a second sparge pipe on the opposite edge of the aperture.

11. A grate assembly as set forth in claim 1 wherein the sparge pipe has a substantially rectangular cross section shape, whereby the first parts to the cooling medium circulation system related to the edge of the aperture system are placed in connection with upper corners of the sparge pipes situated at the opposite edges of the apertures so that the first part is placed, at least partially, in the area of the upper surface of the sparge pipe when viewed from horizontal side.

* * * * *